US009841712B2

(12) United States Patent
Amano

(10) Patent No.: US 9,841,712 B2
(45) Date of Patent: Dec. 12, 2017

(54) FIXING DEVICE, HEATING MEMBER, AND IMAGE FORMING APPARATUS

(71) Applicant: FUJI XEROX CO., LTD., Tokyo (JP)

(72) Inventor: Jumpei Amano, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/245,733

(22) Filed: Aug. 24, 2016

(65) Prior Publication Data

US 2017/0219972 A1 Aug. 3, 2017

(30) Foreign Application Priority Data

Feb. 2, 2016 (JP) ..... 2016-018049

(51) Int. Cl.
*G03G 15/20* (2006.01)

(52) U.S. Cl.
CPC ..... *G03G 15/2053* (2013.01)

(58) Field of Classification Search
USPC ..... 399/107, 110, 122, 320, 328, 329; 219/216, 619
See application file for complete search history.

(56) References Cited

U.S. PATENT DOCUMENTS 6,864,461 B2 * 3/2005 Okabayashi ..... G03G 15/2064 219/216
8,543,025 B2 * 9/2013 Ikebuchi ..... G03G 15/2039 399/329
2011/0229228 A1 9/2011 Yoshikawa et al.

FOREIGN PATENT DOCUMENTS

JP 2011-197182 A 10/2011
JP 5447045 B2 3/2014

* cited by examiner

*Primary Examiner* — Hoan Tran
(74) *Attorney, Agent, or Firm* — Oliff PLC

(57) ABSTRACT

A fixing device includes a belt member that moves in a circulating manner, a pressure member that is disposed to be in contact with an outer circumferential surface of the belt member, and pressurizes a recording material on which an image is formed, and a heating member. The heating member includes a curved portion that is curved along an inner circumferential surface of the belt member and is in contact with the inner circumferential surface, a bent portion that is bent from an upstream side end portion of the curved portion in a moving direction of the belt member and is separated from the inner circumferential surface, and a heat generation portion that is provided in the curved portion and heats the belt member. A generated heat amount in the curved portion on the upstream side is larger than that in the curved portion on a downstream side.

12 Claims, 6 Drawing Sheets

FIXING DEVICE, HEATING MEMBER, AND IMAGE FORMING APPARATUS

CROSS-REFERENCE TO RELATED APPLICATIONS

This application is based on and claims priority under 35 USC 119 from Japanese Patent Application No. 2016-018049 filed Feb. 2, 2016.

BACKGROUND

Technical Field

The present invention relates to a fixing device, a heating member, and an image forming apparatus.

SUMMARY

According to an aspect of the invention, a fixing device includes a belt member that moves in a circulating manner, a pressure member that is disposed to be in contact with an outer circumferential surface of the belt member, and pressurizes a recording material on which an image is formed, and a heating member. The heating member includes a curved portion that is curved along an inner circumferential surface of the belt member and is in contact with the inner circumferential surface, a bent portion that is bent from an upstream side end portion of the curved portion in a moving direction of the belt member and is separated from the inner circumferential surface, and a heat generation portion that is provided in the curved portion, generates heat upon energization, and heats the belt member. A generated heat amount in the curved portion on the upstream side in the moving direction is larger than a generated heat amount in the curved portion on a downstream side in the moving direction.

BRIEF DESCRIPTION OF THE DRAWINGS

Exemplary embodiments of the present invention will be described in detail based on the following figures, wherein.

DETAILED DESCRIPTION

Hereinafter, the exemplary embodiment of the invention will be described in detail with reference to the attached drawings.

Figure 1:
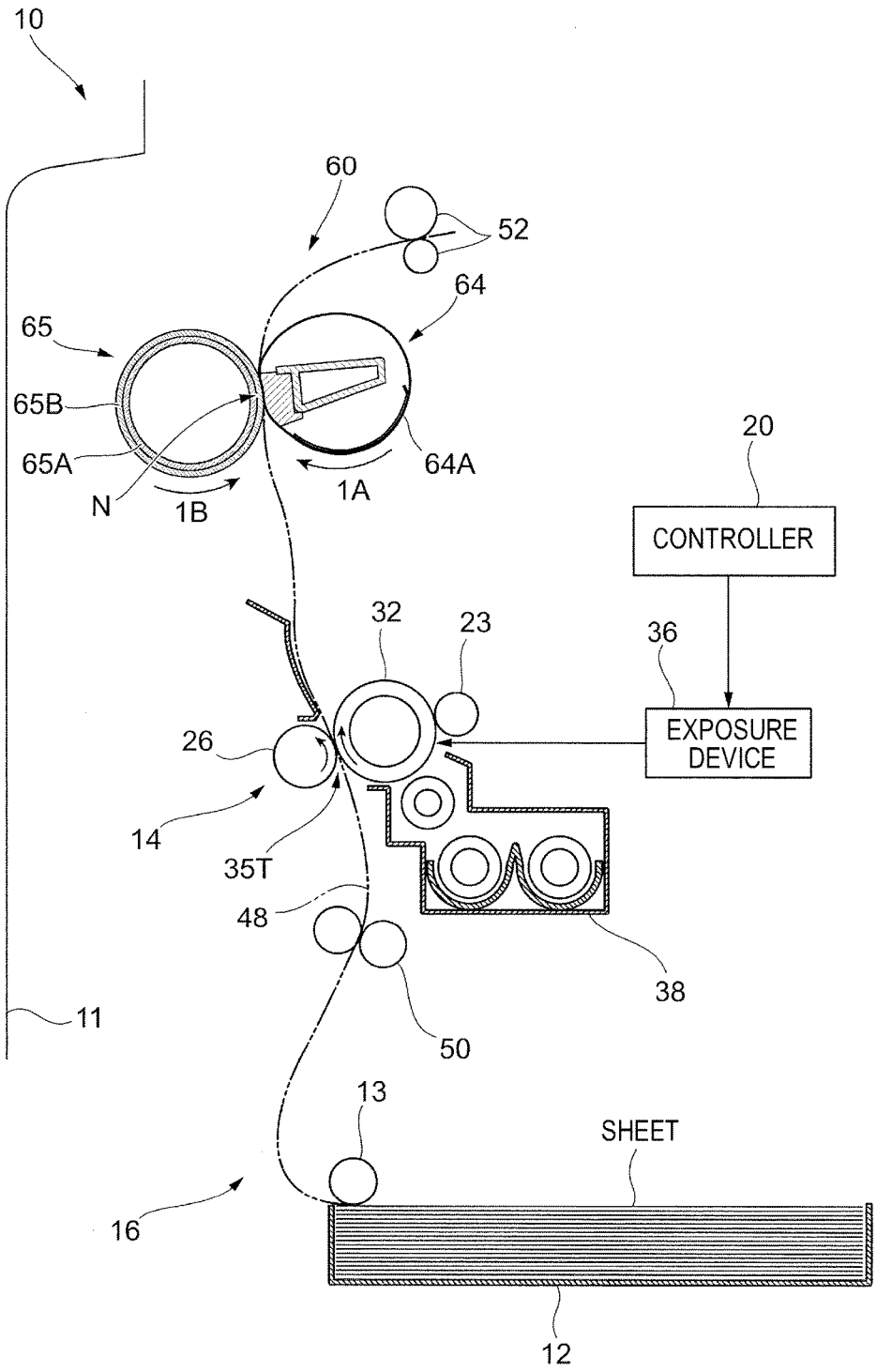
FIG. 1 is a view illustrating a configuration of an image forming apparatus according to an exemplary embodiment.

FIG. 1 is a view illustrating a configuration of an image forming apparatus 10 according to the exemplary embodiment.

A housing 11 is provided in the image forming apparatus 10. On the inside of the housing 11, an accommodating container 12 which accommodates a sheet which is an example of a recording material, and an image forming portion 14 which is an example of an image forming unit that performs image-forming on the sheet, are provided.

In addition, on the inside of the housing 11, a sheet transporting mechanism 16 which transports the sheet to the image forming portion 14 from the accommodating container 12, and a controller 20 which controls operations of each portion of the image forming apparatus 10, are provided.

In addition, above the housing 11, a sheet loading portion (not illustrated) which loads the sheet on which the image is formed, is provided.

A photoconductor drum 32 which rotates in the clockwise direction in the drawing is provided in the image forming portion 14. Furthermore, in the image forming portion 14, a transfer roll 26 which rotates in the counterclockwise direction in the drawing and transfers a toner image held by the photoconductor drum 32 to the sheet, is provided. In addition, in the exemplary embodiment, the image forming apparatus 10 in which one photoconductor drum 32 is installed is illustrated as an example, but the image forming apparatus 10 may be a so-called tandem type in which plural photoconductor drums 32 are installed.

In addition, in the image forming portion 14, a charging roll 23 which is disposed around the photoconductor drum 32 and charges the photoconductor drum 32 is provided. Furthermore, in the image forming portion 14, based on the image data from the controller 20, an exposure device 36 which exposes the photoconductor drum 32 and forms an electrostatic latent image in the photoconductor drum 32, is provided.

Furthermore, in the image forming portion 14, a developing device 38 which develops the electrostatic latent image formed by the exposure device 36 and forms the toner image on the photoconductor drum 32, is provided.

In the sheet transporting mechanism 16, a sheet passing path 48 which is a path through which the sheet passes, is provided. Furthermore, in the sheet transporting mechanism 16, a transport roller 50 which transports the sheet is provided beside the sheet passing path 48. In addition, in FIG. 1, only one group of transport rollers 50 is illustrated, but plural groups of transport rollers 50 are provided.

In addition, at an upper part (on the downstream side of a transfer portion 35T in the transporting direction of the sheet) of the drawing from the transfer portion 35T formed by the photoconductor drum 32 and the transfer roll 26, a fixing device 60 which fixes the transferred toner image on the sheet to the sheet, is provided.

Furthermore, at the upper part of the drawing of the fixing device 60, a transport roller 52 which transports the sheet to which the toner image is fixed to the sheet loading portion (not illustrated), is provided.

In the image forming apparatus 10 of the exemplary embodiment, first, the uppermost sheet among the sheets accommodated in the accommodating container 12 is sent out onto the sheet passing path 48 by a sending roll 13.

Next, the sheet is transported to the transfer portion 35T by the transport roller 50 provided on the sheet passing path 48.

Meanwhile, in the image forming portion 14, the charging of the photoconductor drum 32 by the charging roll 23, and the exposure of the photoconductor drum 32 by the exposure device 36 are performed, and the electrostatic latent image is formed on the photoconductor drum 32. Next, the electrostatic latent image is developed by the developing device 38, and the toner image is formed on the photoconductor drum 32.

In addition, the toner image is transferred to the sheet in the transfer portion 35T by the transfer roll 26. After this, the sheet is transported to the fixing device 60, and heating processing and pressurizing processing are performed on the sheet by the fixing device 60. In addition, the sheet which passes through the fixing device 60 is loaded on the sheet loading portion which is not illustrated.

Figure 2:
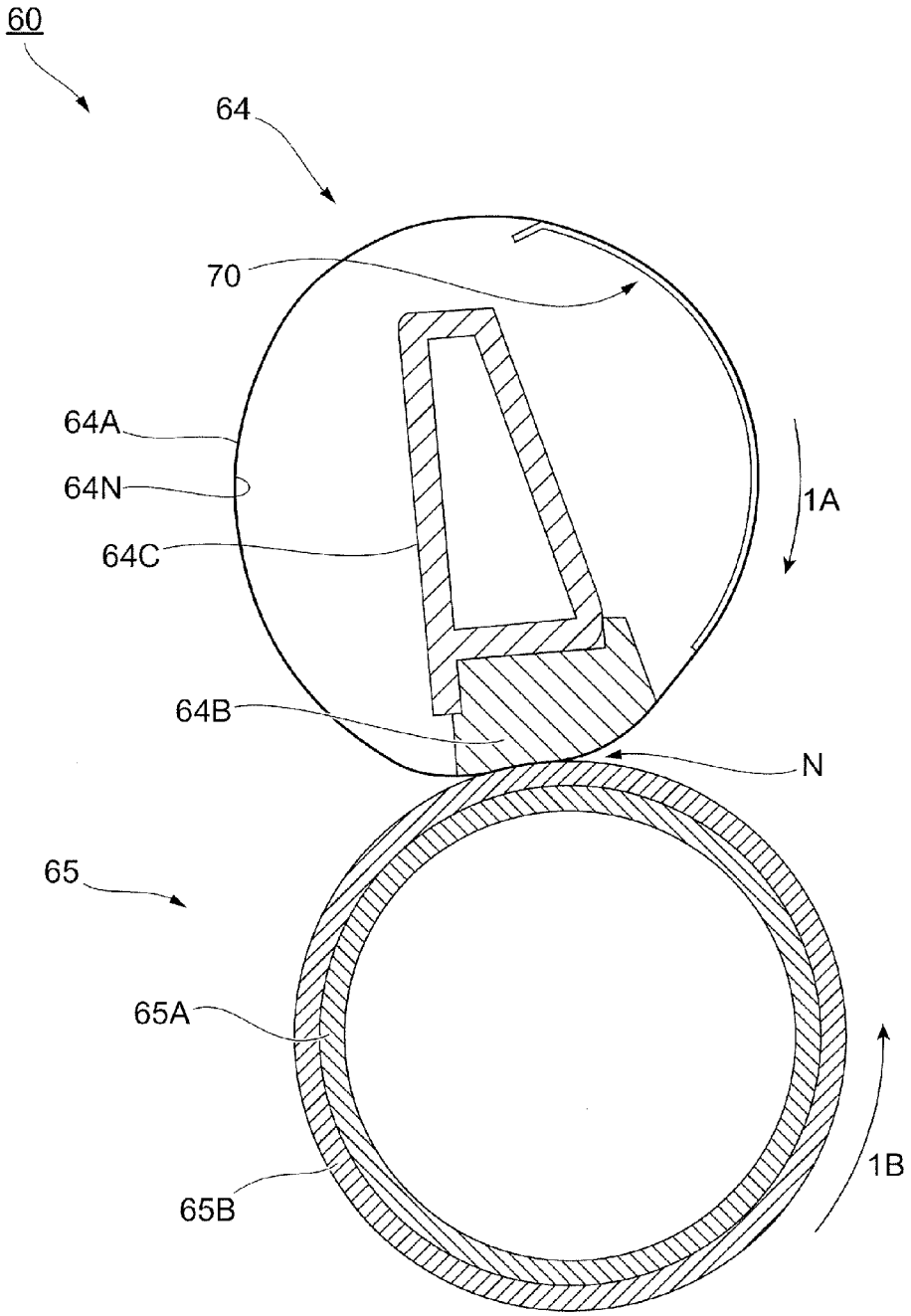
FIG. 2 is a view illustrating a configuration of a fixing device according to the exemplary embodiment.

Next, a configuration of the fixing device 60 will be described. FIG. 2 is a view illustrating a configuration of the fixing device 60 in which the exemplary embodiment is employed.

As illustrated in FIG. 2, in the fixing device 60 of the exemplary embodiment, as illustrated in FIGS. 1 and 2, a fixing belt module 64 which is used in fixing the toner image to the sheet, is provided. In addition, in the fixing device 60, a pressure roll 65 which abuts against the fixing belt module 64 is provided.

In the fixing belt module 64, a belt member 64A formed in an annular (endless) shape is provided. The belt member 64A rotates in the direction illustrated by an arrow 1A in FIG. 1, and circulates and moves. Furthermore, in the fixing device 60 of the exemplary embodiment, an inner circumferential surface 64N of the belt member 64A is coated with oil, to thereby reduce sliding resistances between the belt member 64A and other members which are in contact with the inner circumferential surface 64N of the belt member 64A.

In addition, in the exemplary embodiment, oil (for example, silicone oil) is used as an example of lubricant for reducing the sliding resistance between the belt member 64A and other members, but other types of lubricant may be used. Examples of other types of lubricant include a solid material (for example, zinc stearate), or synthetic lubricating oil grease (for example, silicone grease or fluorine grease) into which a solid material and liquid are mixed.

In addition, in the fixing belt module 64, a pressing pad 64B which presses against the pressure roll 65 via the belt member 64A is provided. In the fixing device 60 of the exemplary embodiment, a nip portion N is formed between the pressing pad 64B and the pressure roll 65.

Furthermore, in the fixing belt module 64, a support frame 64C which supports the pressing pad 64B is provided.

Furthermore, a heating member 70 is provided in the fixing belt module 64. The heating member 70 is in contact with the inner circumferential surface 64N of the belt member 64A and heats the belt member 64A.

Although will be described later in detail, the heating member 70 of the exemplary embodiment is configured of a flexible heat generating member having a thin plate shape.

In the fixing belt module 64 of the exemplary embodiment, the heating member 70 is installed at a position different from the nip portion N. Accordingly, compared to a case where the heating member 70 is installed at the nip portion N, the strength of the heating member 70 decreases, and according to this, it is possible to reduce heat capacity of the heating member 70.

In this case, the heat is prevented from being deprived by the heating member 70, and warmup time of the fixing device 60 is further shortened.

In addition, in a configuration in which the heating member 70 is installed in the nip portion N, since a relatively large load acts on the heating member 70 from the nip portion N, it is necessary that the rigidity of the heating member 70 increases. In this case, the heat capacity of the heating member 70 increases, and the warmup time of the fixing device 60 increases.

The pressure roll 65 abuts against the outer circumferential surface of the belt member 64A provided in the fixing belt module 64, and pressurizes the sheet on which the image is formed.

In the pressure roll 65, a cylindrical member 65A formed of a metal material is provided. Furthermore, in the pressure roll 65, an elastic layer 65B which is stacked on the outer circumference of the cylindrical member 65A and formed of a material having elasticity, is provided.

In the fixing device 60 of the exemplary embodiment, the sheet is supplied to the nip portion N which is a part at which the fixing belt module 64 and the pressure roll 65 are in contact with each other, and the sheet is pressed by the fixing belt module 64 and the pressure roll 65 at the nip portion N. Accordingly, the toner image on the sheet is pressurized and heated, and the toner image is fixed to the sheet.

In addition, in the fixing device 60 of the exemplary embodiment, the pressure roll 65 rotates in the direction illustrated by an arrow 1B by a motor which is not illustrated, and the belt member 64A of the fixing belt module 64 is driven by the pressure roll 65 and rotates in the direction illustrated by the arrow 1A.

Figure 3:
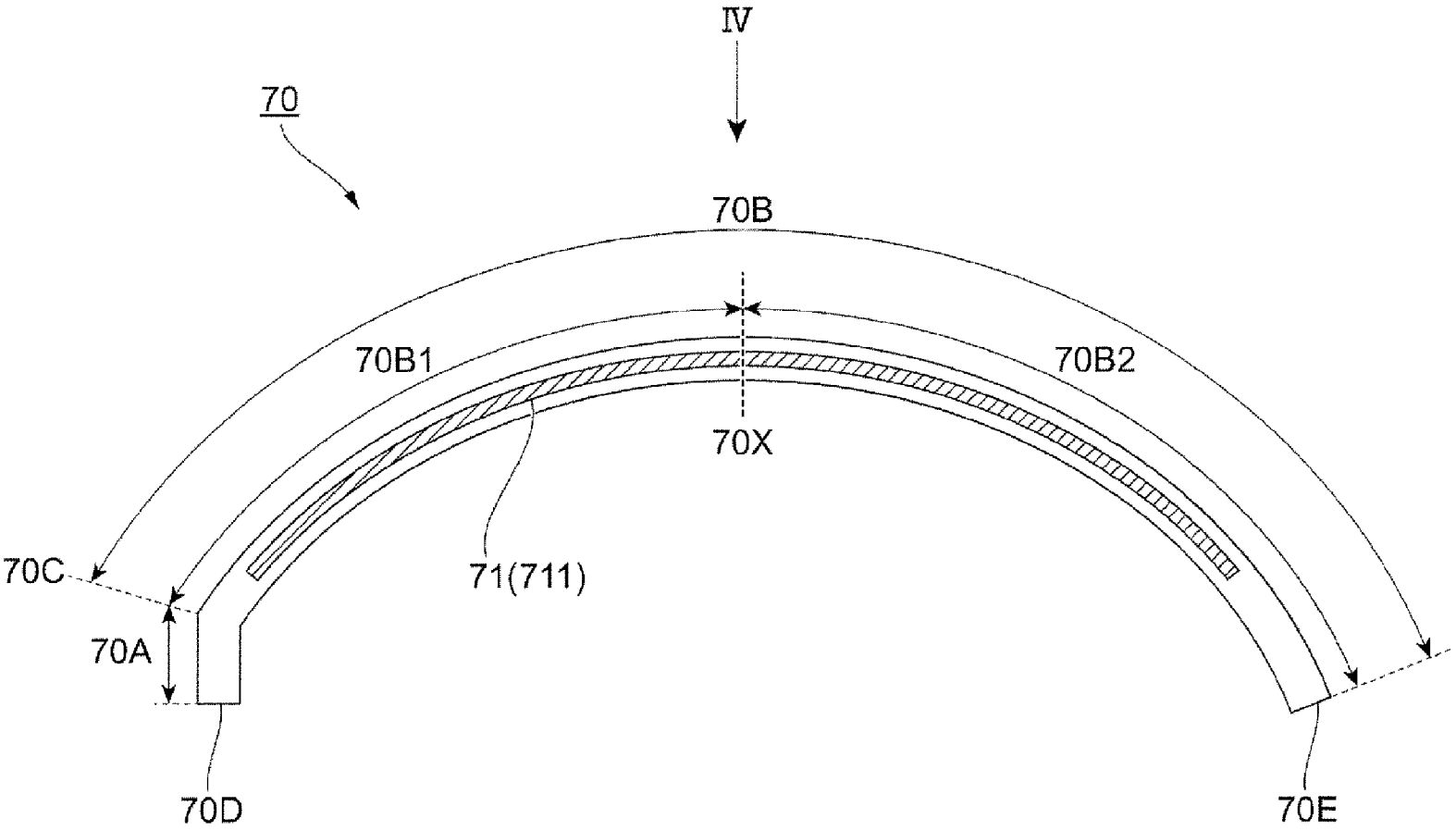
FIG. 3 is a view illustrating a heating member according to the exemplary embodiment, and is a view when the heating member is viewed in the width direction of a belt member.
Figure 4:
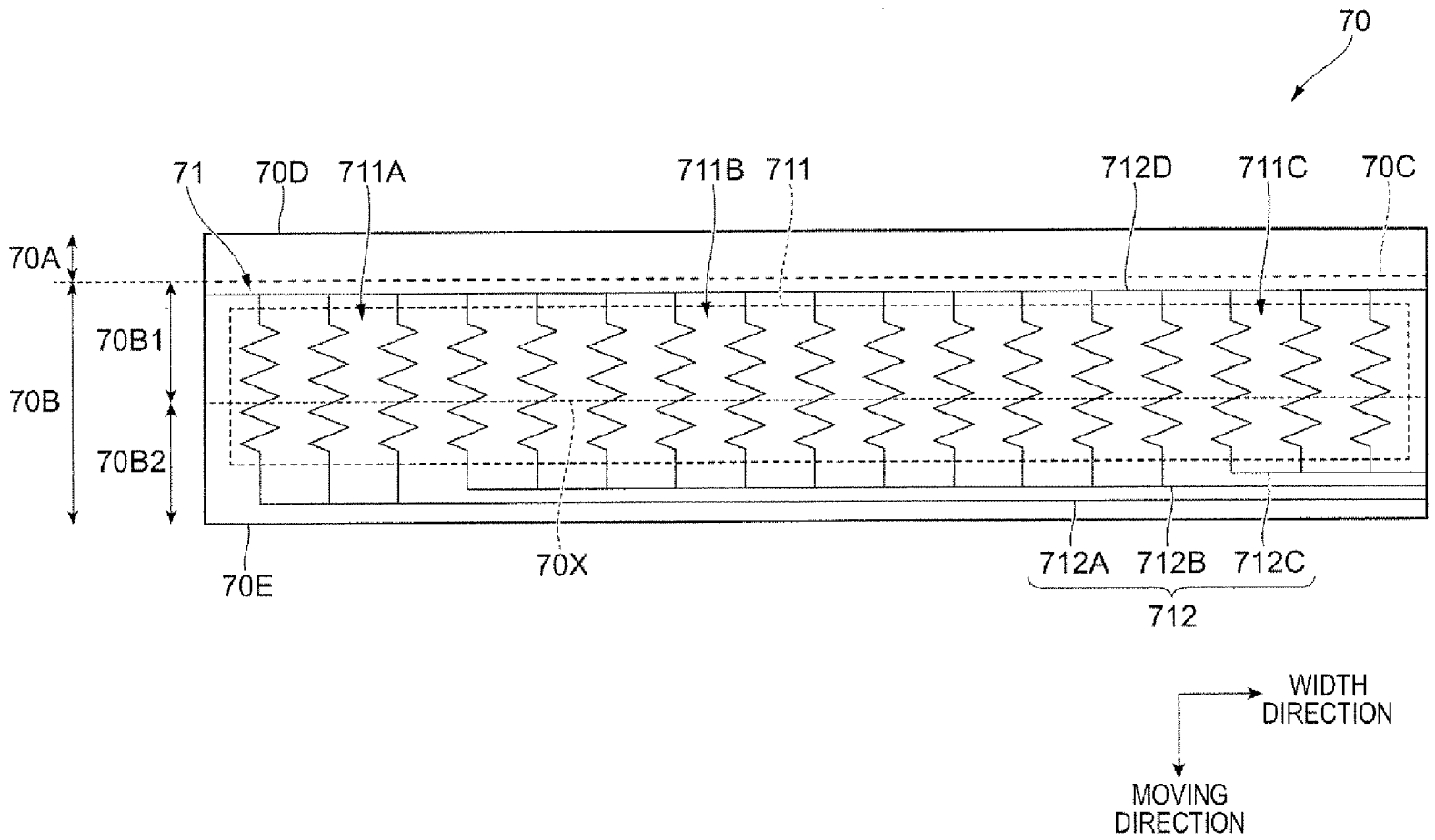
FIG. 4 is a view when the heating member is viewed from the IV direction in FIG. 3.

Next, a configuration of the heating member 70 in which the exemplary embodiment is employed will be described in detail. FIG. 3 is a view illustrating the heating member 70 in which the exemplary embodiment is employed, and is a view when the heating member 70 is viewed in the width direction of the belt member 64A (refer to FIG. 2). In addition, FIG. 4 is a view when the heating member 70 is viewed from the IV direction in FIG. 3.

In addition, there is a case where the width direction of the belt member 64A in the following description is simply referred to as "width direction". In addition, in the description above, there is a case where the moving direction (the direction illustrated by the arrow 1A in FIG. 2) of the belt member 64A is simply referred to as "moving direction".

As described above, the heating member 70 of the exemplary embodiment is configured of the heat generating member having a thin plate shape that extends along the width direction of the belt member 64A. A heat generation pattern 71 is provided in the heating member 70. As illustrated in FIGS. 3 and 4, the heat generation pattern 71 extends along the width direction and generates the heat upon energization.

The heating member 70 of the exemplary embodiment is obtained, for example, by stacking an insulating member made of glass or the like on a plate-shaped base material made of SUS or the like, and by further stacking the insulating member on the heat generation pattern 71 after printing the heat generation pattern 71 made of AgPd or the like on the stacked insulating member.

A curved portion 70B is provided in the heating member 70 of the exemplary embodiment. As illustrated in FIGS. 3 and 4, the curved portion 70B is curved to follow the inner circumferential surface 64N (refer to FIG. 2) of the belt member 64A (refer to FIG. 2). The curved portion 70B is provided to face the inner circumferential surface 64N of the belt member 64A in a state where the heating member 70 is installed on the inner circumference of the belt member 64A. In addition, the curved portion 70B is formed in a state where the outer circumferential surface has a curvature to be swollen toward the inner circumferential surface 64N side of the belt member 64A.

Furthermore, a bent portion 70A is provided in the heating member 70. The bent portion 70A is bent toward the inner circumferential side of the belt member 64A via a folding portion 70C that extends in the width direction on the upstream side in the moving direction of the belt member 64A on the curved portion 70B, is provided. The bent portion 70A is bent in the direction of being separated from the inner circumferential surface 64N of the belt member 64A in a state where the heating member 70 is installed on the inner circumference of the belt member 64A.

In addition, the heating member 70 includes an upstream side end portion 70D which is located on the upstream side in the moving direction of the belt member 64A, and a downstream side end portion 70E which is located on the downstream side in the moving direction of the belt member 64A. In this example, the upstream side end portion 70D is provided in the end portion of the bent portion 70A on the upstream side in the moving direction, and the downstream side end portion 70E is provided in the end portion of the curved portion 70B on the downstream side in the moving direction.

In the exemplary embodiment, the above-described heat generation pattern 71 is formed in the curved portion 70B of the heating member 70.

As illustrated in FIG. 4, the heat generation pattern 71 includes a heat generation portion 711 which generates the heat upon energization. In addition, the heat generation pattern 71 includes a power feeding portion 712 which feeds the electricity to the heat generation portion 711 connected to the heat generation portion 711. In addition, in the heating member 70, the heat generation portion 711 in the heat generation pattern 71 mainly generates the heat, and the power feeding portion 712 rarely generates the heat.

In the heating member 70 illustrated in FIG. 4, the heat generation portion 711 is divided into three regions, that is a first heat generation portion 711A, a second heat generation portion 711B, and a third heat generation portion 711C, across from one end to the other end (from the left side to the right side in FIG. 4) in the width direction.

In addition, the power feeding portion 712 is provided on the downstream side in the moving direction in the curved portion 70B, and includes a first heat generation portion 711A, a second heat generation portion 711B, and a third heat generation portion 712C which are respectively connected to the first power feeding portion 712A, the second power feeding portion 712B, and the third heat generation portion 711C. Furthermore, the power feeding portion 712 includes a common power feeding portion 712D which is provided on the upstream side in the moving direction in the curved portion 70B, and is connected to the first heat generation portion 711A, the second heat generation portion 711B, and the third heat generation portion 711C.

In the exemplary embodiment, by employing such a configuration, the first heat generation portion 711A, the second heat generation portion 711B, and the third heat generation portion 711C can be energized separately, to generate the heat.

In addition, in the fixing device 60 of the exemplary embodiment, for example, in a case where the toner image is fixed to a sheet having a narrow width, only the second heat generation portion 711B is energized which is located at the center portion in the width direction. Accordingly, for example, compared to a case where the entire heat generation portion 711 is energized, excessive heat generating is prevented in the heating member 70, and the power consumption is reduced.

Here, in the heating member 70 of the exemplary embodiment, the heat generation pattern 71 is formed only in the curved portion 70B, and the heat generation pattern 71 is not provided in the bent portion 70A. By employing such a configuration, in the folding portion 70C which is a boundary between the bent portion 70A and the curved portion 70B, the heat generation pattern 71 is prevented from being folded in the thickness direction of the heating member 70. Accordingly, disconnection of the heat generation pattern 71 or generation of temperature unevenness or the like in the heat generation pattern 71, is prevented.

In addition, in the heating member 70 of the exemplary embodiment, as illustrated in FIG. 4, a gap (region in which the heat generation pattern 71 is not formed) is formed between the heat generation pattern 71 and the folding portion 70C. More specifically, the gap is formed between the common power feeding portion 712D of the heat generation pattern 71 and the folding portion 70C. Similarly, in the heating member 70, a gap is formed between the heat generation pattern 71 and the downstream side end portion 70E. More specifically, the gap is formed between the first power feeding portion 712A of the heat generation pattern 71 and the downstream side end portion 70E.

In addition, the bent portion 70A on the upstream side in the moving direction is provided in the heating member 70 of the exemplary embodiment. Thereby, in a case where the heating member 70 is installed on the inner circumference of the belt member 64A, the upstream side end portion 70D of the heating member 70 is in a state of being separated from the inner circumferential surface 64N of the belt member 64A.

As being separated, the oil which adheres to the inner circumferential surface 64N of the belt member 64A is prevented from being scraped by the upstream side end portion 70D of the heating member 70. As a result, the oil enters between the heating member 70 and the inner circumferential surface 64N of the belt member 64A.

Here, when the upstream side end portion 70D of the heating member 70 comes into contact with the inner circumferential surface 64N of the belt member 64A, the oil is likely to be blocked by the upstream side end portion 70D, and the oil is unlikely to enter between the heating member 70 and the inner circumferential surface 64N of the belt member 64A. In addition, in this case, the oil is unlikely to reach the contact portion between the pressing pad 64B and the inner circumferential surface 64N of the belt member 64A.

In addition, in this case, the wear of the belt member 64A, the heating member 70, and the pressing pad 64B is accelerated. In this case, the belt member 64A is unlikely to rotate, and transporting failure of the sheet or wrinkle of the sheet is likely to be generated.

However, in the heating member 70 having the heat generation pattern 71, in a case where the bent portion 70A is provided for preventing the oil from being scraped, there is a case where a warpage is generated in the heating member 70 due to thermal expansion according to the disposition or the like of the heat generation pattern 71.

Figure 6:
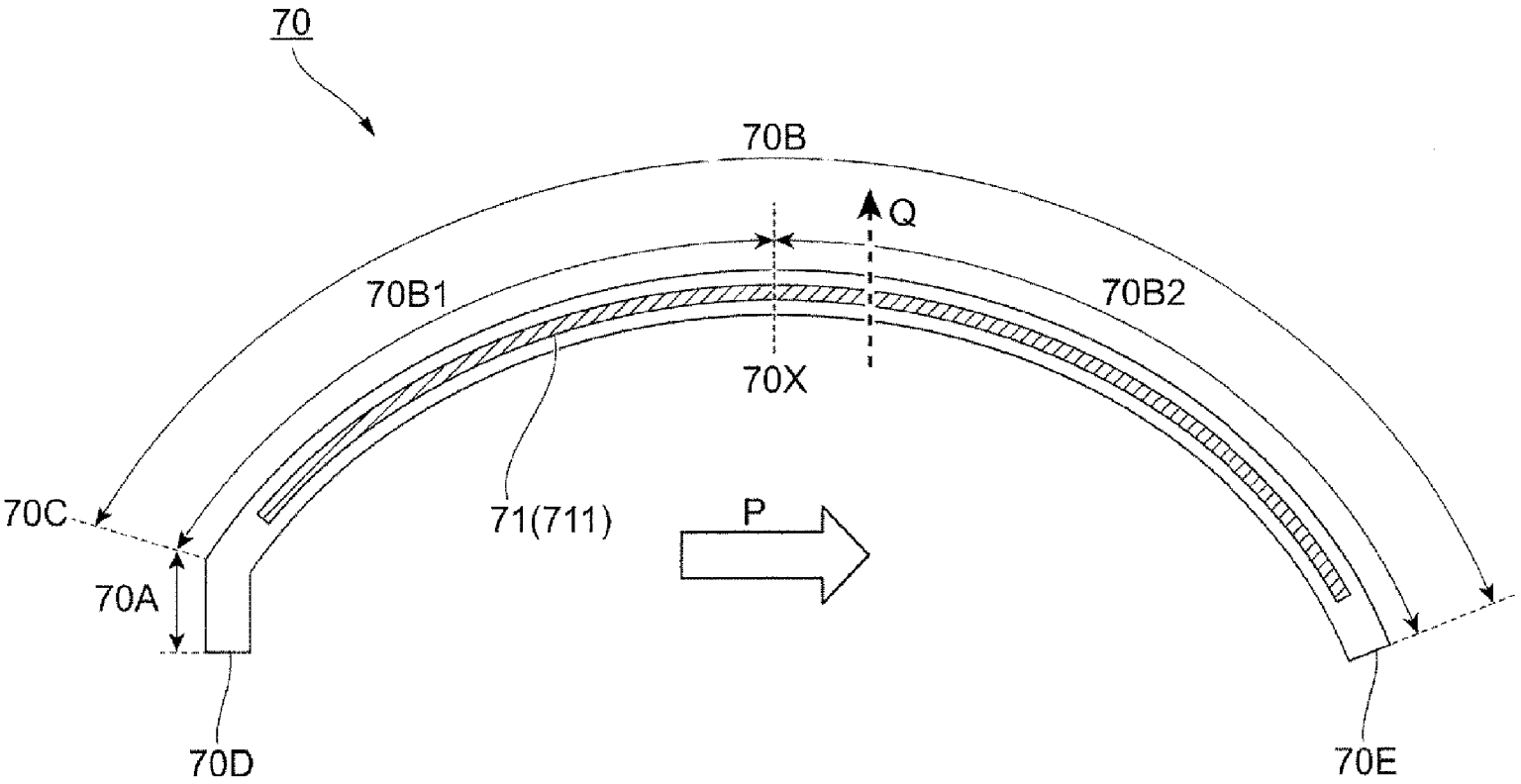
FIG. 6 is a view illustrating an example of a configuration of a heating member in the related art, and is a view when the heating member is viewed in the width direction of a belt member.

FIG. 6 is a view illustrating an example of a configuration of the heating member 70 in the related art, and is a view when the heating member 70 is viewed in the width direction of the belt member 64A (refer to FIG. 2). In addition, in FIG. 6, configuration elements similar to those of FIGS. 1 to 4 will be given the same reference numerals.

In the heating member 70 in the related art illustrated in FIG. 6, in the curved portion 70B, the heat generation pattern 71 is disposed in the center portion in the moving direction. More specifically, in the curved portion 70B, the heat generation pattern 71 is disposed to make a generated heat amounts by the heat generation portion 711 equal to each other in an upstream portion 70B1 which is located on the upstream side of a center line 70X in the moving direction and in a downstream portion 70B2 which is located on the downstream side of the center line 70X in the moving direction.

In other words, in the heating member 70 in the related art illustrated in FIG. 6, the heat generation pattern 71 is disposed so that the center line in the moving direction in the heat generation portion 711 of the heat generation pattern 71 matches the center line 70X of the heating member 70.

In other words, in the heating member 70 illustrated in FIG. 6, the distance from the folding portion 70C which is a boundary between the curved portion 70B and the bent portion 70A to the heat generation portion 711, and the distance from the downstream side end portion 70E to the heat generation portion 711, is equal to each other. Accordingly, in a case where the entire heating member 70 is viewed, the distance from the upstream side end portion 70D to the heat generation portion 711 becomes longer than the distance from the downstream side end portion 70E to the heat generation portion 711. In other words, in the heating member 70 of FIG. 6, an area of a region in which the heat generation portion 711 is not provided is larger than that on the upstream side in the moving direction than that on the downstream side in the moving direction.

In a case where the heat generation pattern 71 is disposed in the heating member 70 in this manner, when the heat generation portion 711 generates the heat by energizing the heat generation pattern 71, warpage toward the width direction may occur in the heating member 70.

Specifically, in a case where the heat generation pattern 71 generates the heat, in the heating member 70, the temperature of the center portion in the moving direction in the curved portion 70B provided with the heat generation pattern 71 (heat generation portion 711) becomes high.

Meanwhile, near the bent portion 70A, or the folding portion 70C and the downstream side end portion 70E, which are not provided with the heat generation pattern 71, the temperature increases by the conduction of the heat generated by the heat generation pattern 71, and the temperature becomes lower than that of the center portion in the moving direction in the curved portion 70B.

Here, as described above, in the heating member 70 of FIG. 6, an area of a region, in which the heat generation portion 711 is not provided, on the upstream side in the moving direction is larger than that of the region on the downstream side in the moving direction. Therefore, when the heat generation pattern 71 generates the heat, in a case where the entire heating member 70 is viewed, the temperature on the upstream side in the moving direction in the heating member 70 is lower than the temperature on the downstream side in the moving direction in the heating member 70. In other words, when the entire heating member 70 is viewed, the temperature on the downstream side in the moving direction in the heating member 70 is higher than the temperature on the upstream side in the moving direction in the heating member 70.

The heating member 70 has a thin plate shape having flexibility as described above, and is deformed by thermal expansion due to the increase in the temperature. In addition, in a case where the heat generation pattern 71 generates the heat, the heating member 70 illustrated in FIG. 6 is more largely deformed on the downstream side in the moving direction in the heating member 70 than on the upstream side in the moving direction in the heating member 70 due to a temperature difference.

Therefore, as illustrated by an arrow P in FIG. 6, there is a concern that a warpage from the upstream side toward the downstream side in the moving direction is generated in the heating member 70. Here, the heating member 70 has a thin plate shape, and the length thereof along the moving direction is greater than the thickness thereof. Therefore, the rigidity in the moving direction of the heating member 70 is larger than the rigidity in the thickness direction of the heating member 70, and a warpage in the moving direction generated in the heating member 70 is unlikely to be corrected by an external force.

In the heating member 70, in addition to the warpage from the upstream side toward the downstream side in the moving direction, a warpage in the thickness direction of the heating member 70 is generated in the curved portion 70B as illustrated by a dashed arrow Q of FIG. 6. However, since the rigidity of the thickness direction of the heating member 70 is small, the curved portion 70B of the heating member 70 can correct warpage of the heating member 70 in the thickness direction by stress or the like applied from the belt member 64A by the inner circumferential surface 64N (refer to FIG. 2) of the belt member 64A (refer to FIG. 2). Therefore, the warpage in the thickness direction of the heating member 70 is unlikely to become a problem.

Regarding the problem, in the exemplary embodiment, by making the disposition of the heat generation pattern 71 (heat generation portion 711) in the heating member 70 different from that of FIG. 6, the warpage of the above-described heating member 70 in the moving direction is prevented. Hereinafter, by using the above-described FIGS. 2 to 4, a configuration of the heating member 70 of the exemplary embodiment will be described in detail.

In the heating member 70 of the exemplary embodiment, the heat generation pattern 71 is arranged in the following manner. That is, a generated heat amount by the heat generation portion 711 of the upstream portion 70B1 of the curved portion 70B which is located on the upstream side of the center line 70X in the moving direction is equal to that of the heat generation portion 711 of the downstream portion 70B2 of the curved portion 70B which is located on the downstream side of the center line 70X in the moving direction.

In other words, in the heating member 70 of the exemplary embodiment, compared to the heating member 70 illustrated in FIG. 6, the position of the heat generation pattern 71 is shifted to the upstream side in the moving direction.

In other words, in the heating member 70 of the exemplary embodiment, the distance from the folding portion 70C which is the boundary between the curved portion 70B and the bent portion 70A to the heat generation portion 711, becomes shorter than the distance from the downstream side end portion 70E to the heat generation portion 711. Accordingly, in the heating member 70 of the exemplary embodiment, the difference between the distance from the upstream side end portion 70D to the heat generation portion 711 and the distance from the downstream side end portion 70E to the heat generation portion 711 is smaller than that of the heating member 70 illustrated in FIG. 6.

In addition, in the heating member 70 of the exemplary embodiment, it is preferable that the heat generation pattern 71 is disposed so that the distance from the upstream side end portion 70D to the heat generation portion 711 is equal to the distance from the downstream side end portion 70E to the heat generation portion 711.

Figure 5:
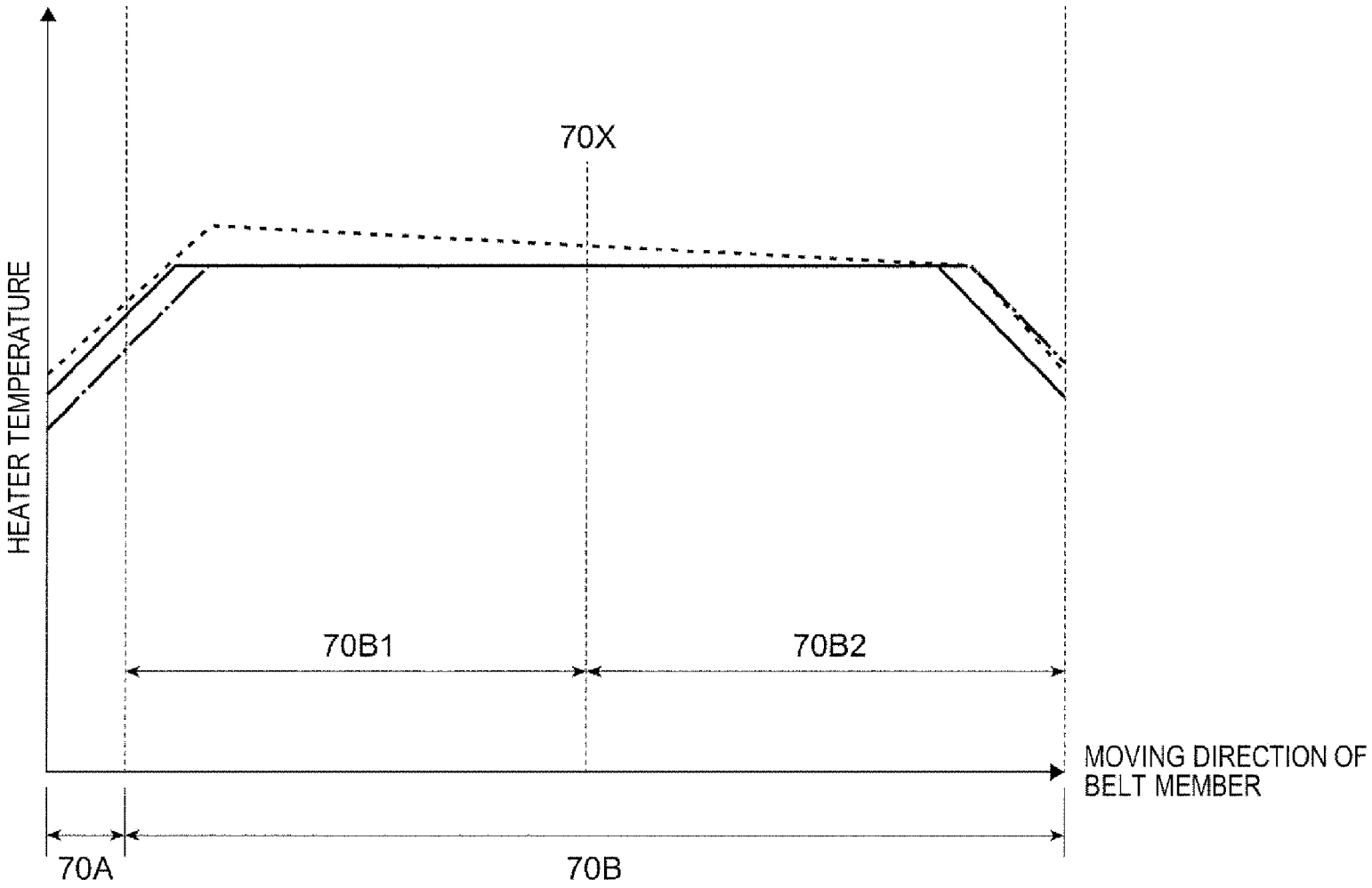
FIG. 5 is a graph illustrating an example of the temperature of the heating member in the moving direction.

FIG. 5 is a graph illustrating an example of the temperature of the heating member 70 in the moving direction. In FIG. 5, the solid line illustrates the temperature of the heating member 70 of the exemplary embodiment, and one-dot chain line illustrates the temperature of the heating member 70 in the related art illustrated in FIG. 6. In addition, in FIG. 5, the dashed line illustrates the temperature of the heating member 70 in which the other configuration which will be described later is employed.

As illustrated by the solid line in FIG. 5, in the heating member 70 of the exemplary embodiment, the region (in FIG. 5, a region which is flat along the horizontal axis) in which the heat generation portion 711 generates the heat is shifted to the upstream side of the center line 70X of the curved portion 70B in the moving direction compared to the heating member 70 in the related art illustrated in FIG. 6.

As a result, in the heating member 70 of the exemplary embodiment, the temperature of the heating member 70 near the bent portion 70A and the upstream side end portion 70D is higher than that of the heating member 70 in the related art illustrated in FIG. 6. In addition, in the heating member 70 of the exemplary embodiment, the temperature difference between the upstream side and the downstream side in the moving direction is smaller than that of the heating member 70 in the related art illustrated in FIG. 6.

Accordingly, in the heating member 70 of the exemplary embodiment, compared to the heating member 70 in the related art illustrated in FIG. 6, the difference in a modification amount due to the thermal expansion between the upstream side and the downstream side in the moving direction is reduced. Therefore, in the exemplary embodiment, the warpage of the heating member 70 in the moving direction is reduced.

Here, as described above, in the heating member 70 of the exemplary embodiment illustrated in FIGS. 2 to 4, the position of the heat generation pattern 71 (heat generation portion 711) in the curved portion 70B is shifted to the upstream side in the moving direction compared to the heating member 70 in the related art illustrated in FIG. 6. Accordingly, in the curved portion 70B, the generated heat amount of the upstream portion 70B1 located on the upstream side of the center line 70X in the moving direction is larger than that of the downstream portion 70B2 located on the upstream side of the center line 70X in the moving direction. Thereby, the warpage of the heating member 70 in the moving direction is reduced. However, a configuration for making the generated heat amount of the upstream portion 70B1 larger than that of the downstream portion 70B2 is not limited thereto.

For example, the heat generation pattern 71 (heat generation portion 711) may be disposed in the center portion in the moving direction in the curved portion 70B similar to the heating member 70 in the related art illustrated in FIG. 6, and density (area) of the heat generation portion 711 in the upstream portion 70B1 with respect to the center line 70X in the moving direction may be made larger than that of the downstream portion 70B2. Accordingly, in the curved portion 70B, the generated heat amount of the upstream portion 70B1 can be made larger than that of the downstream portion 70B2.

In addition, in a case where such a configuration is employed, as illustrated by the dashed line in FIG. 5, the temperature in the upstream portion 70B1 is higher than that in the heating member 70 in the related art illustrated in FIG. 6. As a result, the temperature of the heating member 70 near the bent portion 70A and the upstream side end portion 70D is higher than that of the related art illustrated in FIG. 6. Further, the temperature difference between the upstream side and the downstream side in the moving direction of the heating member 70 is smaller than that of the related art illustrated in FIG. 6.

Accordingly, compared to the heating member 70 in the related art illustrated in FIG. 6, the difference in the modification amount due to the heat expansion between the upstream side and the downstream side in the moving direction is reduced, and the warpage of the heating member 70 in the moving direction is reduced.

In addition, as illustrated in FIGS. 2 to 4, the density of the heat generation portion 711 in the upstream portion 70B1 may be made larger than that in the downstream portion 70B2, in addition to the configuration in which the disposition of the heat generation pattern 71 (heat generation portion 711) in the curved portion 70B is shifted to the upstream side in the moving direction. Even in this case, similarly, compared to the heating member 70 in the related art illustrated in FIG. 6, the difference in deformation amount due to the heat expansion between the upstream side and the downstream side in the moving direction is reduced, and the warpage in the moving direction of the heating member 70 is reduced.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a belt member that circularly moves in a moving direction;

a pressure member that is disposed to contact an outer circumferential surface of the belt member, and pressurizes a recording material on which an image is formed; and a heating member comprising:

a curved portion that is curved along an inner circumferential surface of the belt member, contacts the inner circumferential surface, and including an upstream portion which is located on an upstream side of a center line of the curved portion in the moving direction, and a downstream portion which is located on a downstream side of the center line of the curved portion in the moving direction;

a bent portion that is bent from an upstream side end portion of the curved portion in the moving direction of the belt member, and is separated from the inner circumferential surface; and a heat generation portion that is disposed in the curved portion, generates heat by energization, and heats the belt member, wherein a generated heat amount of the upstream portion of the curved portion is larger than a generated heat amount of the downstream portion of the curved portion.

2. The fixing device according to claim 1,
wherein the heat generation portion in the heating member is disposed to be shifted to the upstream side from a center of the curved portion in the moving direction.

3. The fixing device according to claim 1,
a heat generation density of the heat generation portion which is located on the upstream side of a center of the curved portion in the moving direction, is larger than that of the heat generation portion which is located on the downstream side of the center of the curved portion in the moving direction.

4. The fixing device according to claim 1,
wherein the inner circumferential surface of the belt member is coated with lubricant, and
the lubricant is entered between the inner circumferential surface and the curved portion of the heating member by circularly moving of the belt member.

5. The fixing device according to claim 1,
wherein the heating member is separated from the pressure member.

6. The fixing device according to claim 1,
wherein the heat generation portion crosses the center line of the curved portion in the moving direction.

7. The fixing device according to claim 1,
a heat generation pattern of the heat generation portion is disposed so that a distance from an upstream side end portion of the bent portion to the heat generation portion is equal to the distance from a downstream side end portion of the curved portion to the heat generation portion.

8. The fixing device according to claim 1,
wherein the downstream portion of the curved portion of the belt member in the moving direction does not have a bent portion.

9. A heating member comprising:
a curved portion that is curved from a first end of the curved portion to a second end of the curved portion opposite to the first end to follow an inner circumferential surface of a belt member that circularly moves;
a bent portion that is bent from the first end of the curved portion toward an inner circumference side of the curved portion; and
a heat generation portion that is disposed in the curved portion and generates heat by energization,
wherein a generated heat amount on a first area defined between the first end and a center line of the curved portion is larger than a generated heat amount on a second area defined between the second end and the center line of the curved portion.

10. The heating member according to claim 9,
wherein the second end of the curved portion of the belt member does not have a bent portion.

11. An image forming apparatus comprising:
an image forming apparatus unit that forms an image on a recording material;
a belt member that circularly moves in a moving direction;
a pressure member that is disposed to contact an outer circumferential surface of the belt member, and that pressurizes the recording material on which the image is formed by the image forming apparatus unit; and
a heating member comprising:
a curved portion that is curved along an inner circumferential surface of the belt member, and contacts the inner circumferential surface, and including an upstream portion which is located on an upstream side of a center line of the curved portion in the moving direction, and a downstream portion which is located on a downstream side of the center line of the curved portion in the moving direction;
a bent portion that is bent from an end portion of the curved portion on an upstream side of the belt member in the moving direction, and is separated from the inner circumferential surface; and
a heat generation portion that is disposed in the curved portion and generates heat by energization,
wherein a generated heat amount of the upstream portion of the curved portion is larger than a generated heat amount of the downstream portion of the curved portion.

12. The image forming apparatus according to claim 11,
wherein the downstream portion of the curved portion of the belt member in the moving direction does not have a bent portion.

* * * * *